US009300049B2

(12) United States Patent
Jo

(10) Patent No.: US 9,300,049 B2
(45) Date of Patent: Mar. 29, 2016

(54) ANTENNA AND PORTABLE DEVICE HAVING THE SAME

(71) Applicant: Samsung Electronics Co., Ltd., Gyeonggi-do (KR)

(72) Inventor: Myungjae Jo, Gyeongsangbuk-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 231 days.

(21) Appl. No.: 14/012,197

(22) Filed: Aug. 28, 2013

(65) Prior Publication Data

US 2014/0062816 A1 Mar. 6, 2014

(30) Foreign Application Priority Data

Aug. 29, 2012 (KR) ..... 10-2012-0094974

(51) Int. Cl.
*H01Q 1/24* (2006.01)
*H01Q 9/04* (2006.01)

(52) U.S. Cl.
CPC . *H01Q 9/04* (2013.01); *H01Q 1/243* (2013.01)

(58) Field of Classification Search
CPC ..... H01Q 1/38; H01Q 1/22; H01Q 1/24; H01Q 1/241; H01Q 1/242; H01Q 1/243; H01Q 1/42; H01Q 1/422; H01Q 1/52; H01Q 3/44; H01Q 9/0485; H01Q 15/08
See application file for complete search history.

(56) References Cited

U.S. PATENT DOCUMENTS

| | | | | |
|---|---|---|---|---|
| 5,320,561 | A * | 6/1994 | Cook et al. | 439/500 |
| 7,852,258 | B2 * | 12/2010 | Kato et al. | 342/82 |
| 8,421,689 | B2 * | 4/2013 | Schlub et al. | 343/702 |
| 2007/0296638 | A1 | 12/2007 | Kim et al. | |
| 2009/0069061 | A1 | 3/2009 | Laurent et al. | |
| 2010/0137042 | A1 * | 6/2010 | Na et al. | 455/575.5 |
| 2010/0234081 | A1 | 9/2010 | Wong et al. | |
| 2010/0302123 | A1 | 12/2010 | Knudsen et al. | |
| 2011/0260932 | A1 | 10/2011 | Hong et al. | |
| 2012/0050114 | A1 | 3/2012 | Li et al. | |

FOREIGN PATENT DOCUMENTS

| | | | |
|---|---|---|---|
| EP | 1 870 956 | A1 | 12/2007 |
| EP | 2 192 652 | A1 | 6/2010 |
| EP | 2 381 530 | A2 | 10/2011 |
| JP | 2005-102286 | A | 4/2005 |
| JP | 2007-180704 | A | 7/2007 |
| KR | 10-2012-0027985 | A | 3/2012 |
| KR | 10-2012-0056699 | A | 6/2012 |

* cited by examiner

*Primary Examiner* — Robert Karacsony
*Assistant Examiner* — Patrick Holecek
(74) *Attorney, Agent, or Firm* — Cha & Reiter, LLC.

(57) ABSTRACT

An antenna and a portable device having the same are provided. The antenna provided in a portable device includes: a radiator unit housed at one surface of the portable device; and a resonant frequency compensation unit housed at another surface of the portable device facing the one surface and adjusting a resonant frequency of the radiator unit changed by an environment change to a preset resonant frequency. Examples of the environment change include a device color change, and a battery size change.

21 Claims, 9 Drawing Sheets

FIG. 6

| | Device color | Low ch | | Mid ch | | High ch | |
|---|---|---|---|---|---|---|---|
| | | TIS | TRP | TIS | TRP | TIS | TRP |
| Reference value | blue | 104.5 | 27.5 | 104.3 | 28.2 | 104.0 | 28.3 |
| Before change | red | 104.6 | 28.5 | 104.4 | 28.3 | 102.9 | 28.2 |
| | white | 104.2 | 26.3 | 104.1 | 27.4 | 104.2 | 28.2 |
| After change | red | 104.6 | 27.6 | 104.2 | 28.3 | 104.1 | 28.5 |
| | white | 104.3 | 27.5 | 104.4 | 28.0 | 104.3 | 28.4 |

ANTENNA AND PORTABLE DEVICE HAVING THE SAME

CLAIM OF PRIORITY

This application claims the benefit under 35 U.S.C. §119(a) of a Korean patent application filed on Aug. 29, 2012 in the Korean Intellectual Property Office and assigned Serial No. 10-2012-0094974, the entire disclosure of which is hereby incorporated by reference.

BACKGROUND

1. Technical Field

The present disclosure relates to an antenna and portable electronic device having the same, and more particularly, to an antenna of a portable device with optimized performance under varying environmental conditions.

2. Description of the Related Art

In general, a mobile terminal, portable terminal and portable device are synonymous for a hand held electronic device capable of transmitting and/or receiving an information or communication signal. Examples include smartphones, tablet PCs, laptops, cell phones, e-readers, communication-capable cameras, and so forth. Modern mobile terminals have advanced to a small size, small thickness, and light weight in consideration of portability, and have achieved advances in a multimedia direction, that is, they can perform various functions in various multimedia and Internet environments. High speed data communication capability in addition to an audio dedicated communication function are common. Further, prototypes with higher data communication speeds are under development.

General mobile terminals essentially include a data input and output device, processor, speaker, microphone, and antenna. In recent designs, internal (built-in) antennas are widely used.

The mobile terminal is widely used for multimedia data communication as well as a telephony function. In early designs, a single antenna was used to handle both telephony and data communication functions. However, as multimedia related data communication has increased, recent models employ multiple antennas for voice and data communication functions.

Further, as a communication method develops from a presently widely using 3G communication method to a 4G long term evolution (LTE) communication method, a 4G communication antenna is separately added, increasing the number of antennas mounted in the mobile terminal. Space constraints within a small mobile terminal, however, make it difficult to package the antennas while maintaining requisite antenna performance.

In addition, it is desirable for a portable device manufacturer to provide the consumer with diverse color options for a given device model. However, a phenomenon occurs in which a material and a dielectric constant of the portable device housing changes as a function of the color. The change in dielectric constant of the housing in proximity to the antenna influences the antenna performance. That is, a resonant frequency of the antenna differs according to the housing color.

In order to compensate a resonant frequency of an antenna changed according to a color change, conventionally, a mold of an antenna radiator is separately produced on a color basis and thus a radiator pattern is separately produced according to the housing color. This approach, however, is not cost effective in that several different molds are required, and the number of parts for a given production model increases. Further, even if an antenna is produced on a color basis, errors inevitably occur in a resonant frequency.

Accordingly, there is a need for an efficient way to ensure that an antenna packaged within the confines of a portable device meets resonant frequency and other performance requirements under changing environmental conditions, such as a housing color change.

SUMMARY

Disclosed is an antenna and a portable device having the same that can simply compensate a change of a resonant frequency according to a change of a dielectric constant by an environment change in the vicinity of the antenna.

The present disclosure further provides an antenna and portable device having the same that can utilize the same method and antenna radiator pattern regardless of a color and a material of the portable device and a capacity of a battery mounted at a periphery thereof.

The present disclosure further provides an antenna and portable device having the same that can produce the portable device in a small thickness while securing various antenna mounting space thereof and securing mounting space for other parts.

The present disclosure further provides an antenna and portable device having the same that can reduce a cost and improve reliability of the antenna by simplifying an antenna producing process.

In accordance with an aspect, an antenna provided in a portable device includes: a radiator housed at one surface of the portable device; and a resonant frequency compensation unit housed at another surface of the portable device facing the one surface, and adjusting a resonant frequency of the radiator changed by an environment change to a preset resonant frequency.

In accordance with another aspect, a battery cover detached from a case in which a battery and an antenna are housed and separated by a predetermined gap includes: a resonant frequency compensation unit housed in the battery cover facing the antenna and adjusting a resonant frequency of the antenna to a preset resonant frequency.

In accordance with another aspect of the present invention, a portable device having an antenna includes: a case in which a battery is mounted; an antenna radiator patterned at a surface of a lower end portion of the case; a battery cover detached from the case and covering the battery; and a dielectric tuner housed in the battery cover facing the antenna radiator and for adjusting a resonant frequency of the antenna radiator changed by an environment change to a preset resonant frequency.

BRIEF DESCRIPTION OF THE DRAWINGS

The aspects, features and advantages of the present invention will be more apparent from the following detailed description in conjunction with the accompanying drawings, in which:

FIG. 6 is a table illustrating a total isotropic sensitivity (TIS)/total radiated power (TRP) measurement result of an antenna on a color basis according to an exemplary embodiment of the present invention;

DETAILED DESCRIPTION

Figure 1:
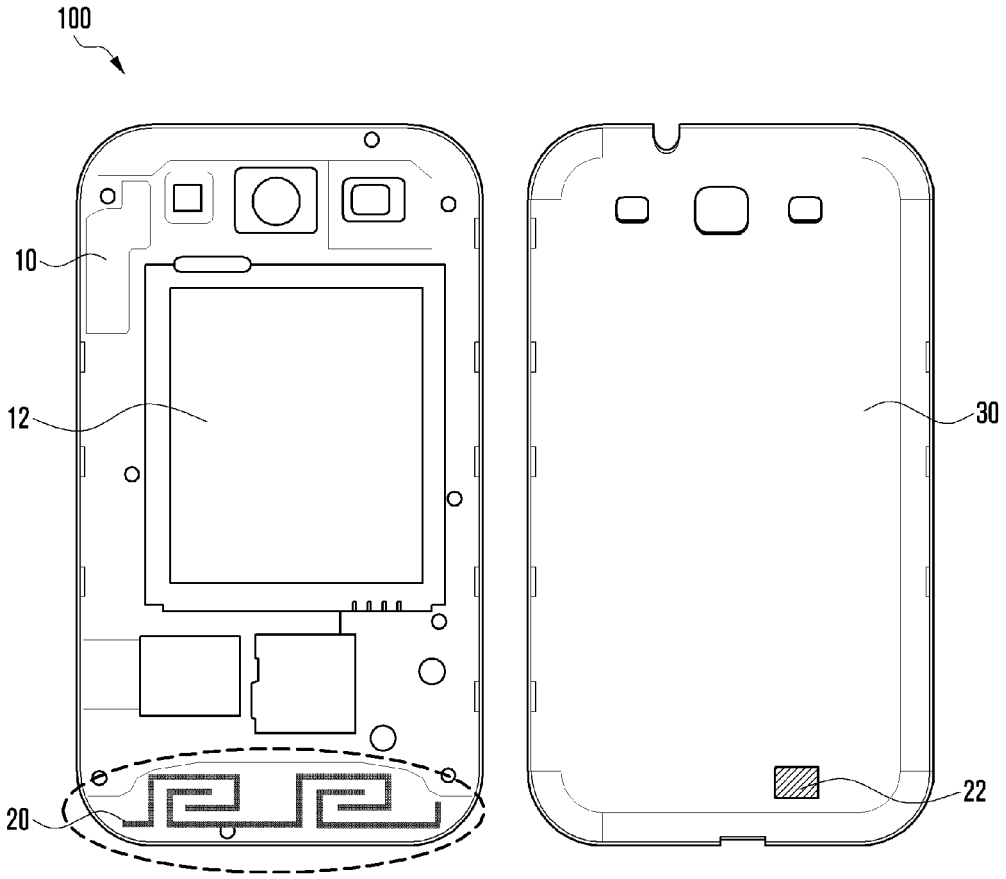
FIG. 1 is a diagram illustrating a structure of a portable device and antenna thereof according to an exemplary embodiment of the present invention.

Hereinafter, exemplary embodiments of the present invention are described in detail with reference to the accompanying drawings. The same reference numbers are used throughout the drawings to refer to the same or like parts. The views in the drawings are schematic views only, and are not intended to be to scale or correctly proportioned. Detailed descriptions of well-known functions and structures incorporated herein may be omitted to avoid obscuring the subject matter of the present invention.

An antenna and a mobile terminal having the same according to an exemplary embodiment of the present invention provide a dielectric tuner, which is a small block of dielectric material acting as an antenna tuner. The dielectric tuner can be pre-set based on a dielectric constant changed by an environment in the vicinity of the antenna of the portable device. As the dielectric tuner changes a dielectric constant in proximity to the antenna, a resonant frequency of the antenna is adjusted to a preset resonant frequency. Accordingly, a common construction method and radiator pattern can be used for the antenna regardless of a nearby environment, such as a change in the portable device housing color or material. The dielectric tuner can be configured to differ in form, size or location as a function of the environment change.

The dielectric tuner is also be referred to herein as a "resonant frequency compensation unit".

Further, an antenna according to the present exemplary embodiment houses a radiator in a front or rear case and attaches an auxiliary dielectric tuner to a battery cover or employs a battery cover having a predetermined dielectric constant, and thus mounting space of the antenna can be extended and a thin portable device can be produced.

In an exemplary embodiment of the present invention, the portable device can be any of a variety of information and communication devices and multimedia devices such as a smartphone, a tablet personal computer (PC), mobile communication terminal, mobile phone, personal digital assistant (PDA), international mobile telecommunication 2000 (IMT-2000) terminal, code division multiple access (CDMA) terminal, wideband code division multiple access (WCDMA) terminal, global system for mobile communication (GSM) terminal, general packet radio service (GPRS) terminal, enhanced data GSM environment (EDGE) terminal, universal mobile telecommunication service (UMTS) terminal, LTE terminal, and digital broadcasting/receiving terminal, communication-capable camera, and laptop computer. The inventive antenna can also be applied to fixed electronic devices such as an automated teller machine (ATM) or home appliance.

Figure 2:
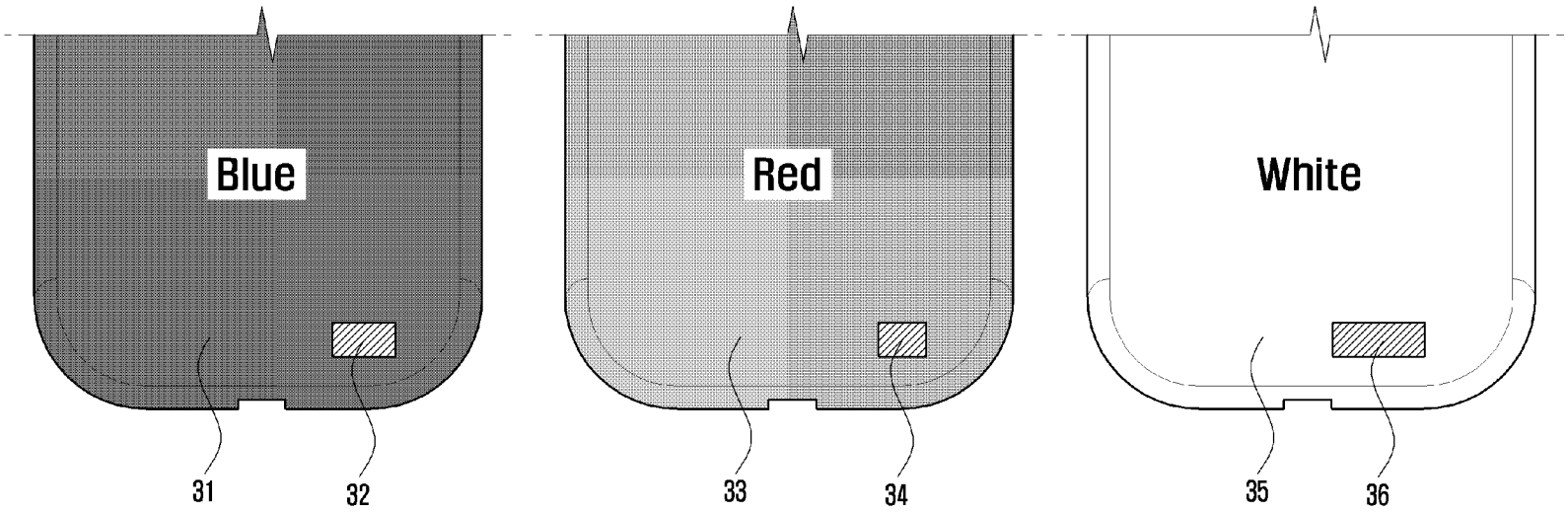
FIG. 2 is a diagram illustrating a portion of a battery cover of a portable device having different colors according to an exemplary embodiment of the present invention.
Figure 3:
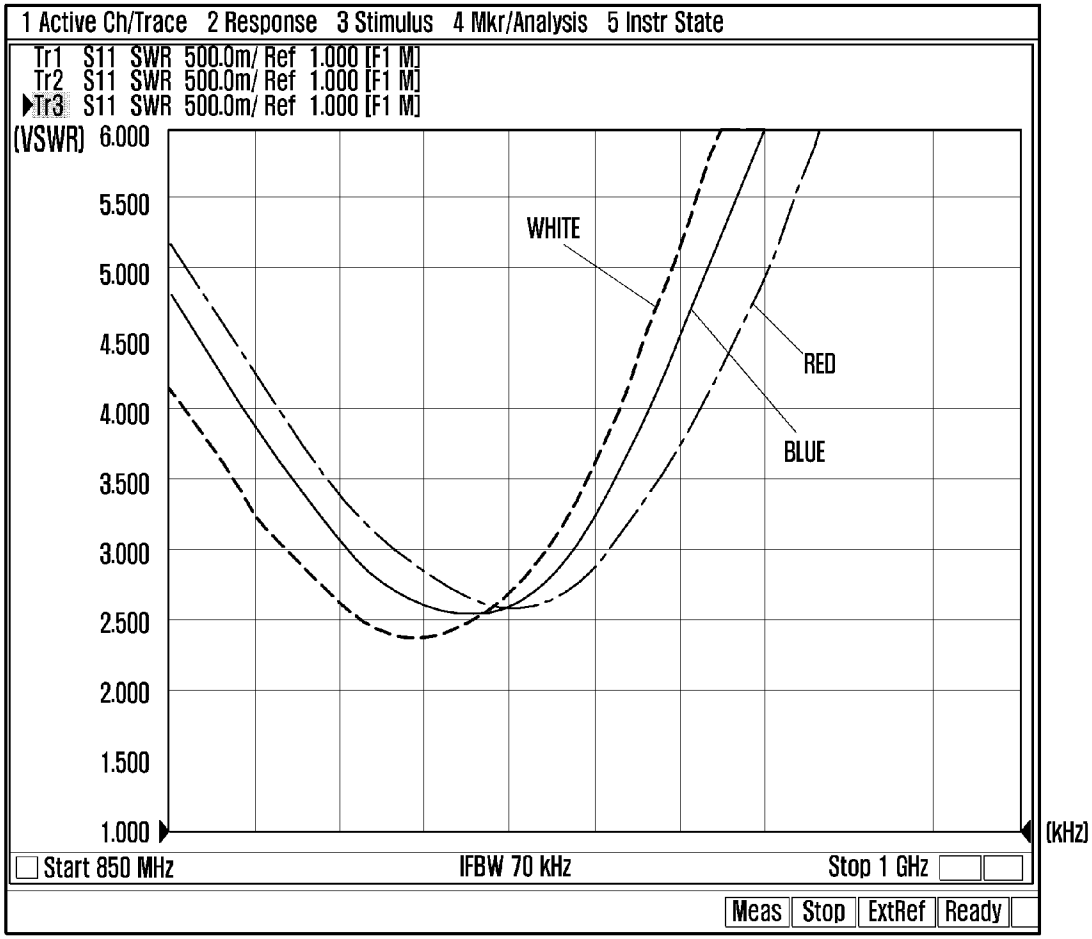
FIG. 3 is a graph illustrating a resonant frequency of antenna patterns of the portable devices having different colors.

FIG. 1 is a diagram illustrating a structure of an antenna 20 and a portable device 100 having the same according to an exemplary embodiment of the present invention. FIG. 2 is a diagram illustrating a portion of a battery cover of the portable device having different colors according to an exemplary embodiment of the present invention. FIG. 3 is a graph illustrating a resonant frequency of antennas employed within portable device housings of different colors.

Referring to FIGS. 1 and 2, the portable device 100 includes a front case 10 in which a battery 12 is mounted and a battery cover 30 (also acting as a rear case of device 100) detached from the case 10 and for covering the battery 12.

An antenna provided in the portable device according to the present exemplary embodiment includes an antenna radiator 20 housed in a portion of the case 10 and a resonant frequency compensation unit (dielectric tuner) 22 housed in the battery cover 30 facing the radiator 20. It is noted that the radiator 20 may also be referred to herein as a radiator pattern 20, or as an antenna.

It is preferable that the radiator 20 is disposed in a lower end portion of the case 10, beneath the battery 12, but is separated from the battery at a predetermined gap so that the battery 12 does not adversely influence the antenna performance (e.g., gain). The radiator 20 may be mounted in a fusion-bonding and in-mold type antenna structure on an upper surface of the case 10. Radiator 20 can also be mounted in the same or similar manner on the case 30. In this case, the dielectric tuner can still be mounted to the case 30, e.g., overlaid on top of the radiator 20. That is, the radiator 20 can be mounted directly on the case 30, and the dielectric tuner 20 can be mounted over the radiator 20, with a suitable attachment means such as a dielectric screw or glue securing it in place.

The antenna radiator 20 may be designed as a radiator for constituting at least one antenna of a Bluetooth antenna (BT), global positioning system (GPS) antenna, WiFi antenna, a GSM mobile communications antenna, code division multiple access (CDMA), wideband code division multiple access (WCDMA), LTE antenna, and diversity antenna.

Further, the radiator 20 may be configured for a single band antenna having a form of a monopole antenna in which a grounding stub is not connected or a single band antenna having a form of a PIFA antenna in which a grounding stub is connected at a periphery of a power supply line. When the radiator 20 has a form of a PIFA antenna, an antenna size may be reduced compared to a monopole configuration, for operation at the same frequency band.

The radiator 20 may be formed with silver (Ag) paste, copper (Cu) paste, or a synthetic substance thereof.

The radiator 20 is electrically connected via a connection means (not shown) to a main printed circuit board (PCB) mounted to the case 10 to transfer a signal received from the outside to the main PCB. Suitable connection means for this purpose are known to those skilled in the art.

As seen in the graph of FIG. 3, a phenomenon in which a dielectric constant of the case 30 adjacent the radiator 20 is changed according to a color or a material painted at the radiator occurs (here, a change of a color or a material painted at the radiator is referred to as a change of an environment of a radiator). Specifically, a graph of FIG. 3 represents resonant frequencies of three antennas produced with the same construction method and pattern, but painted with a red color, blue color, and white color. The graphs of FIG. 3 do not include the influence of the dielectric tuner 22.

Through the graph of FIG. 3, it can be seen that after the portable device covers are painted with different colors, resonant frequencies of the antennas that had the same resonant frequency before painting are changed, i.e., after the portable devices are painted with different colors, resonant frequencies of the antenna are changed. This is because the effective dielectric constant of the cover to which the antenna is proximate, is changed by painting. Hereafter, this effective dielectric constant of one or both covers proximate the radiator 20, will be referred to as an intrinsic dielectric constant of the radiator 20. The term "intrinsic dielectric constant" of the radiator 20 will also refer to a characteristic of the radiator 20 changeable by other environmental influences that impact the antenna performance, e.g., the presence of the tuner 22 and/or the size of the battery 12.

Accordingly, even when an antenna is produced with the same construction method and pattern, an intrinsic dielectric constant of the radiator 20 is changed according to a color or a material painted at a radiator and thus resonant frequencies of radiators are different.

In order to compensate for such a change of a resonant frequency, an antenna according to the present exemplary embodiment employs the resonant frequency compensation unit 22 at a location proximate the antenna, as shown in FIG. 1.

Specifically, the radiator 20 according to the present exemplary embodiment is formed with a shared construction method and pattern of the antenna regardless of a color of a material painted near the radiator.

The antenna employs the resonant frequency compensation unit (hereafter, "tuner") 22 having a predetermined dielectric constant that is pre-set based on a dielectric constant of a radiator changed by a color and a material painted near the radiator.

The tuner 22 is disposed at a suitable distance to the radiator 20, to compensate for the change in dielectric constant caused by the painting of the case 30 and/or 10. In order words, the tuner 22 is disposed at a close distance that induces a change of the intrinsic dielectric constant of the radiator 20.

The present exemplary embodiment illustrates an example in which the tuner 22 is disposed at an inner surface of the battery cover 30 facing the case 10 in which the radiator 20 is mounted, as shown in FIG. 2. However, a mounting position of the tuner 22 is not limited thereto. For example, the radiator 20 can alternatively be mounted to the battery cover 30 and the tuner 22 can be mounted directly over it to the battery cover 30, or the tuner 22 could be mounted to the case 10.

A dielectric constant of the tuner 22 is pre-set to change the intrinsic dielectric constant of the radiator 20. In other words, the dielectric constant of the tuner 22 is set to adjust a resonant frequency of the radiator 20 to a preset resonant frequency.

Here, the preset resonant frequency may be set to a resonant frequency of one of, for example the red, blue, and white color cases. Therefore, a dielectric constant of the tuner 22 provided according to the red, blue, and white cases may be differently provided. Alternatively, the dimensions and/or exact location of the tuner 22 differ as a function of the case color to achieve the desired resonant frequency adjustment.

The tuner 22 may be provided in a form of a dielectric substance attached to one surface of the portable device, as shown in FIG. 2.

When the tuner 22 is provided in a dielectric substance form attached to any surface of the portable device, the tuner 22 adjusts the intrinsic dielectric constant of the radiator 20 through a change of a parameter of at least one of an area, length, and width of the dielectric substance.

For example, for a specific application and design, a generally rectangular dielectric substance 32 may be provided in a polycarbonate (PC) sheet of a size of 5×10 mm to correspond to the blue cover, a dielectric substance 34 may be provided in a polycarbonate (PC) sheet of a size of 5×8 mm to correspond to the red cover, and a dielectric substance 36 may be provided in a polycarbonate (PC) sheet of a size of 5×8 mm to correspond to the white cover. Of course, many other designs are possible. For instance, the dielectric substances may be provided in other geometric shapes, e.g., discs or ellipses.

As an alternative to providing a block of dielectric material to realize the tuner 22, a resonant frequency compensation unit may be provided by employing battery covers 31, 33, and 35 of a material having a predetermined dielectric constant, without utilizing a separate dielectric substance. In this way, a change of a dielectric constant of the covers 31, 33 and 35 produce a change in the intrinsic dielectric constant of the radiator 20, thereby adjusting the resonant frequency as desired to compensate for the dielectric constant change caused by the coloring of the covers.

A material that the resonant frequency compensation unit may be made of, can be at least one of acrylonitrile, butadiene, and styrene (ABS), polyamide (PA), polyacetal (POA), polycarbonate (PC), modified polyoxide (M-PRO), polybutylene terephthalate (PBT), polyimide (PI), polyphenylenesulfide (PPS), polyamide imide (PAI), polyetherimide (PEI), polyether ketone (PEK), liquid crystal polyester (LCP), syndiotactic polypropylene (SPS) or a synthetic substance thereof.

In an exemplary embodiment, ABS that may constitute the resonant frequency compensation unit is a filler, and a characteristic thereof greatly changes according to a combination thereof, and has excellent mechanical characteristics, electrical characteristics, and chemical resistance. Because ABS may be plated, the ABS may be provided with metallic plastic.

The materials have different intrinsic dielectric constants, and when the materials are disposed adjacent to the radiator 20, the intrinsic dielectric constant of the radiator 20 may be changed.

Figure 4:
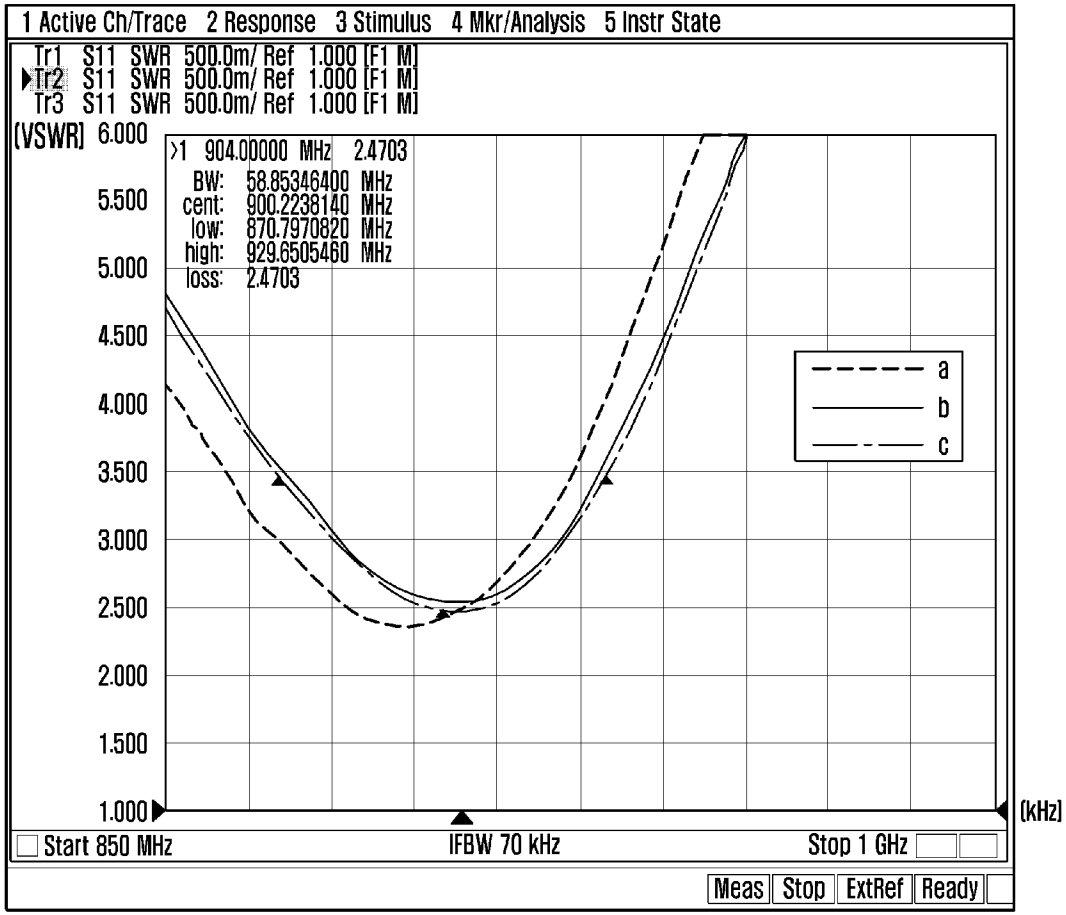
FIG. 4 is a graph comparing resonant frequencies of red and blue color device antennas according to an exemplary embodiment of the present invention and a conventional antenna.
Figure 5:
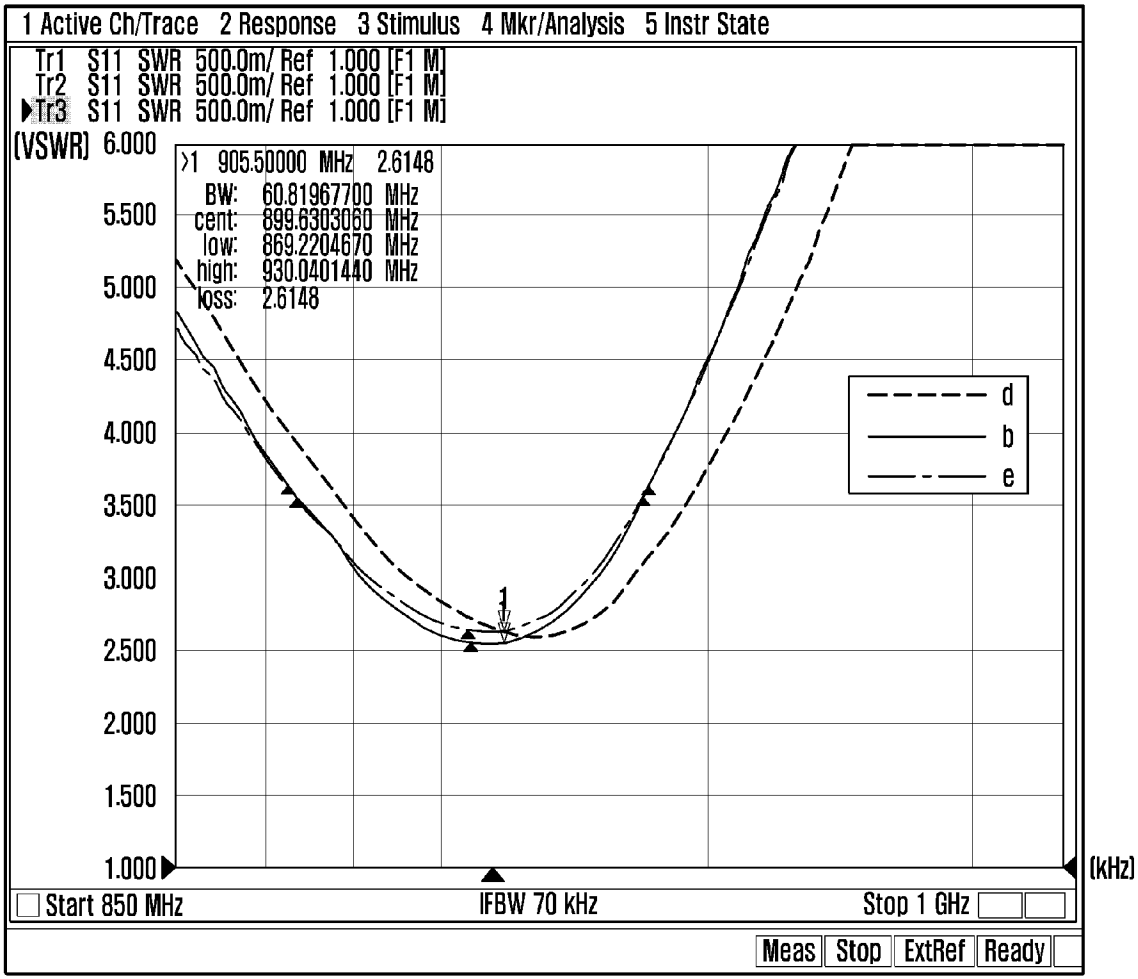
FIG. 5 is a graph comparing resonant frequencies of a white color device antenna according to an exemplary embodiment of the present invention and a conventional antenna.

FIG. 4 is a graph comparing resonant frequencies of a red color device's antenna according to an exemplary embodiment of the present invention, and a conventional device's antenna. FIG. 5 is a graph comparing resonant frequencies of an antenna within a white color portable device according to an exemplary embodiment of the present invention, and a conventional antenna. FIG. 6 is a table illustrating a total isotropic sensitivity (TIS)/total radiated power (TRP) measurement result of an antenna on a color basis according to an exemplary embodiment of the present invention.

Referring to FIGS. 4 to 6, it is assumed that a resonant frequency of a red color device's radiator according to the present exemplary embodiment is set to correspond to, for example a resonant frequency of a blue color device's radiator (i.e., a preset resonant frequency is set to a resonant frequency of a blue color device's radiator).

A graph 'a' shown in FIG. 4 illustrates a graph of VSWR vs. frequency to illustrate a resonant frequency of a conventional red color device antenna, a graph 'b' illustrates a resonant frequency of a blue color device 100 radiator, and a graph 'c' illustrates a resonant frequency of a red color device 100 radiator employing the resonant frequency compensation unit at a periphery thereof according to an exemplary embodiment of the present invention. As seen by the graphs a, b, c, by employing the resonant frequency compensation unit 34 in a red color device 100 a resonant frequency of the radiator 20 is changed to be almost the same as a resonant frequency of a blue color device's radiator 20. Meanwhile, the resonant frequency of the conventional device is shifted below a desired frequency, as the graph 'a' shows.

A graph d shown in FIG. 5 illustrates a resonant frequency of a white device's antenna, and the graph b illustrates a resonant frequency of the blue device's radiator, and a graph e illustrates a resonant frequency of a white device's radiator employing the resonant frequency compensation unit 36 at a periphery thereof.

Referring to the graphs b, d, and e, by employing the resonant frequency compensation unit 36 at a periphery of the white device's radiator, it can be seen that a resonant frequency of the red device's radiator is changed to be almost the same as a resonant frequency of the blue device's radiator.

That is, it can be seen that a resonant frequency of the white device radiator is adjusted by the resonant frequency compensation unit 36 to be changed to approximately the same resonant frequency of the blue device radiator.

Referring to a table shown in FIG. 6, by employing the resonant frequency compensation unit 34 at a periphery of the red device radiator, it can be seen that TIS and TRP of the red device radiator are almost equally changed to TIS and TRP of the blue device radiator.

Similarly, by employing the resonant frequency compensation unit 36 at a periphery of the white device radiator, it can be seen that TIS and TRP of the white device radiator are almost equally changed to TIS and TRP of the blue device radiator.

TIS is defined as average power that can obtain from an ideal isotropic antenna and is a transmitting performance metric of an antenna. TRP is defined as the sum of entire power actually radiated by an antenna regardless of a direction or polarity and is a receiving performance metric of an antenna.

Because such TIS and TRP have a direct correlation to a dielectric constant of an antenna carrier it will be understood by those skilled in the art that a performance change of an antenna according to the present exemplary embodiment can be measured through TIS and TRP.

In the foregoing comparisons, it was assumed that the battery size of each portable device 100 having a different color was the same, and the antenna radiator dimensions in each device 100 are the same. However, if a battery size changes, compensation in dielectric constant of tuners/covers may be required to maintain desired resonance frequencies. This problem is addressed in the embodiments described below.

Figure 7:
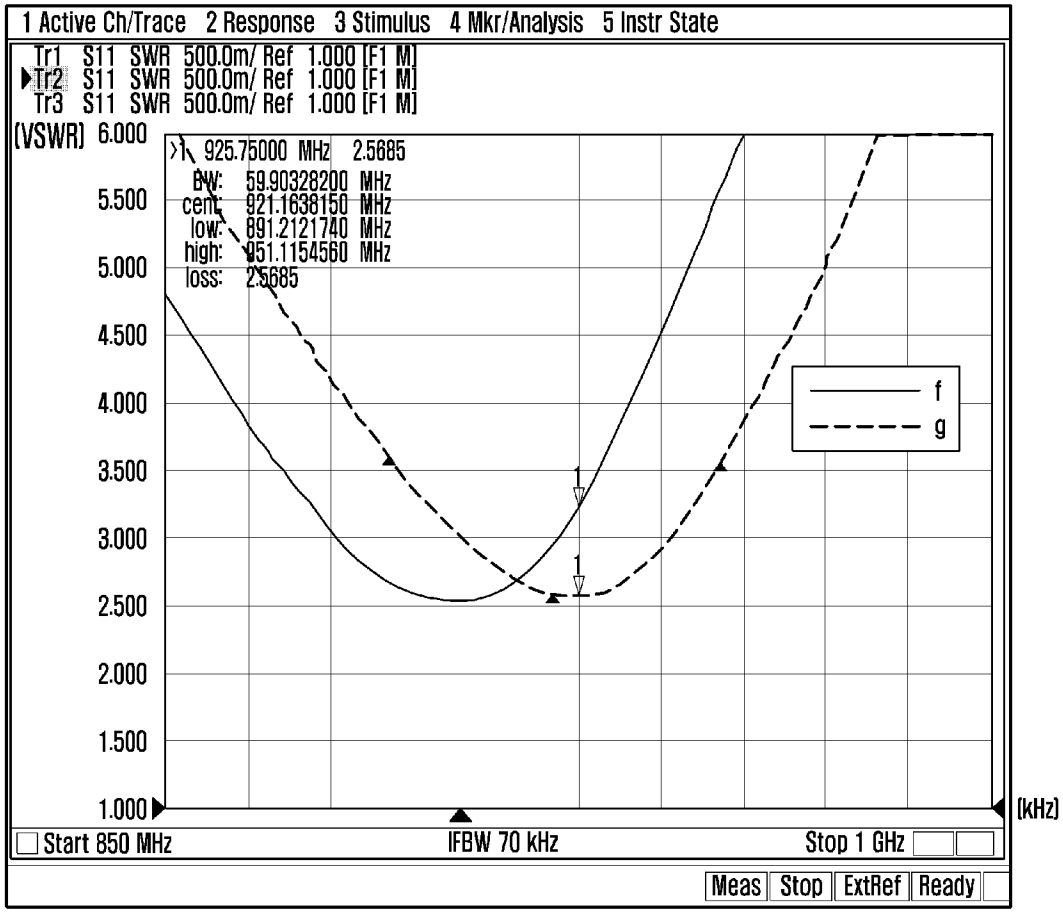
FIG. 7 is a graph illustrating a resonant frequency of radiators provided in a portable device employing a large capacity battery against a standard capacity battery.
Figure 8:
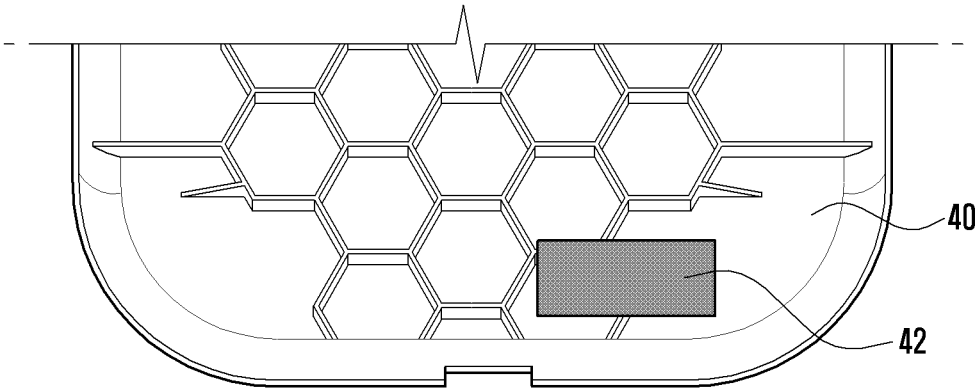
FIG. 8 is a diagram illustrating an antenna according to an exemplary embodiment of the present invention and a portion of a portable device having the same.
Figure 9:
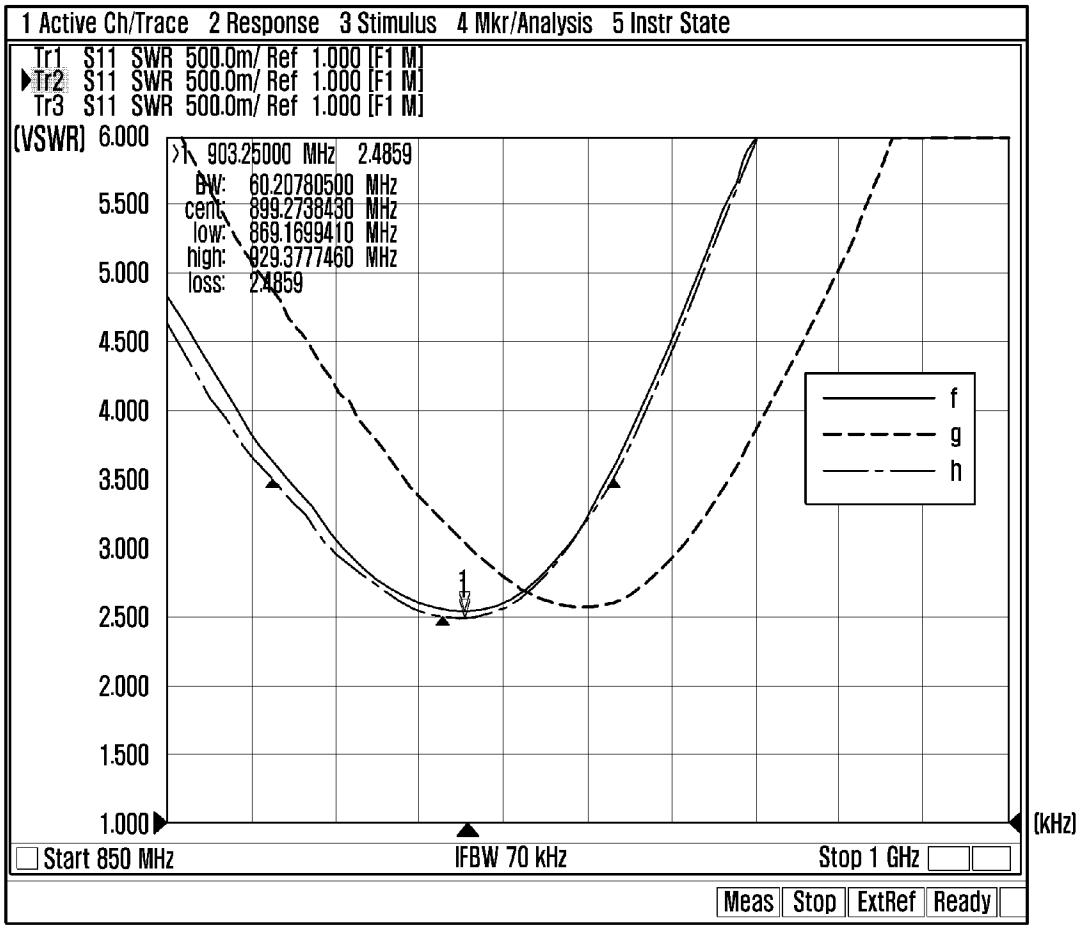
FIG. 9 is a graph comparing resonant frequencies of an antenna according to an exemplary embodiment of the present invention and a conventional antenna.

FIG. 7 is a graph illustrating a resonant frequency of radiator units provided in a portable device employing a large capacity battery against a standard capacity battery. FIG. 8 is a diagram illustrating an antenna according to an exemplary embodiment of the present invention and a portion of a portable device having the same. FIG. 9 is a graph comparing resonant frequencies of an antenna according to an exemplary embodiment of the present invention and a conventional antenna.

It is assumed that antennas described in FIGS. 7 to 9 are produced with the same construction method and radiator pattern and are employed within portable devices having the same color. However, a resonant frequency of antennas in which sizes or capacities of a battery mounted at a periphery thereof are different is exemplified. Because a battery size is generally proportional to a battery capacity, graphs of a resonant frequency of an antenna are compared based on a battery capacity proportional to the battery size.

Before a battery is mounted at a periphery of an antenna, an entire condition of a construction method, pattern, and color of the antenna is the same and thus it is assumed that intrinsic dielectric constants and resonant frequencies of the antenna are the same.

FIG. 7 illustrates a graph f of an antenna at which a standard capacity battery is positioned at a periphery of an antenna and a graph g of an antenna in which a large capacity battery is positioned at a periphery of the antenna. It is seen from the graphs that the resonant frequency of the antenna changes due to the influence of the batteries.

In order to compensate a resonant frequency changed according to a capacity of a battery mounted at a periphery of an antenna, an antenna according to the present exemplary embodiment employs a resonant frequency compensation unit 42 at a periphery of the antenna, as shown in FIG. 8.

Specifically, an antenna according to the present exemplary embodiment may be formed with the same antenna construction method and pattern regardless of a capacity or a size of a battery mounted at a periphery thereof. The antenna employs the resonant frequency compensation unit ("tuner") 42 having a predetermined dielectric constant that is set based on a dielectric constant of a radiator changed due to an influence of a capacity or a size of a battery mounted at a periphery thereof. The tuner 42 is changed according to the battery size.

A configuration, function, and disposition position of the resonant frequency compensation unit 42 are similar or identical to those of the above-described resonant frequency compensation units and therefore a detailed description thereof is omitted.

However, a preset resonant frequency may be set, for example to a resonant frequency of an antenna in which a battery of a standard capacity is mounted at a periphery thereof.

Further, for example, the resonant frequency compensation unit 42 may be provided with a polycarbonate (PC) sheet of 5×10 mm size to correspond to the standard capacity battery, and the dielectric substance 42 may be provided with a PC sheet of 17.5×17.5 mm size to correspond to the large capacity battery. These dimensions are merely exemplary for a particular application; many different sizes may be suitable, depending on the radiator design, the case designs, and the desired resonant frequencies.

Referring to FIG. 9, in the present exemplary embodiment, by employing the resonant frequency compensation unit 42 at a periphery of an antenna in which a large capacity battery is mounted, it can be seen that a resonant frequency g of an antenna in which a large capacity battery is mounted at a periphery thereof becomes almost the same as a preset resonant frequency f. That is, it can be seen that a previous resonant frequency g of the antenna is changed to an adjusted resonant frequency h. Here, the preset resonant frequency is a resonant frequency of an antenna in which a standard capacity of battery is mounted.

As described above, an antenna and a portable device having the same according to the present invention can provide a structure that can simply compensate a resonant frequency change according to a change of a dielectric constant in a surrounding environment of the antenna.

Further, because of a capacity or a size of a battery mounted at a periphery thereof, a changed resonant frequency of an antenna can be adjusted to a preset resonant frequency by employing the inventive tuner.

Further, by positioning a dielectric substance to be adjacent to an antenna, a resonant frequency of the antenna can be adjusted with a simple source. Accordingly, it is unnecessary to separately produce a radiator pattern designated for different resonant frequencies due to different colors and materials and a capacity of a battery mounted at a periphery thereof.

That is, by using a common radiator pattern and by mounting a dielectric block as an accessory at a periphery of the antenna according to a resonant frequency of the antenna, the resonant frequency can be adjusted to a preset resonant frequency.

Accordingly, by compensating a performance change according to a change of an intrinsic dielectric constant of an antenna, a common construction method and radiator pattern of the antenna can be utilized for the differing environments.

Further, because it is unnecessary to separately produce an antenna pattern according to a changed dielectric constant or to change a production construction method, a process is simplified and thus a cost can be reduced and reliability of a product can be improved.

Further, by housing a radiator pattern in a rear case, and by attaching an auxiliary dielectric substance to a battery cover or by employing a battery cover having a predetermined dielectric constant, mounting space of the antenna can be extended, and a thin portable device can be produced.

Although exemplary embodiments of the present invention have been described in detail hereinabove, it should be clearly understood that many variations and modifications of the basic inventive concepts herein described, which may appear to those skilled in the art, will still fall within the spirit and scope of the exemplary embodiments of the present invention as defined in the appended claims.

What is claimed is:

1. An antenna provided in a portable device, comprising:

a radiator disposed at one surface of the portable device; and a resonant frequency compensation unit attached to or forming at least part of another surface of the portable device facing the one surface, and having a predetermined dielectric constant set to adjust a resonant frequency of the antenna changed by an environmental condition to a preset resonant frequency, wherein the environmental condition is at least one of an effective dielectric constant of a case with a particular color or material painted thereon, or the presence of a type of battery mounted within the portable device.

2. The antenna of claim 1, wherein the resonant frequency compensation unit is disposed at a proximate distance that induces a change of an effective dielectric constant in the vicinity of the radiator.

3. The antenna of claim 1, wherein the resonant frequency compensation unit is a dielectric block having the predetermined dielectric constant set based on the effective dielectric constant of the case.

4. The antenna of claim 3, wherein the dielectric block is attached to the other surface of the portable device, and a dielectric constant in the vicinity of the radiator is changed according to adjustment of at least one parameter of an area, length, and width of the resonant frequency compensation unit.

5. The antenna of claim 3, wherein the dielectric block is provided at the other surface of the portable device having a predetermined dielectric constant.

6. The antenna of claim 1, wherein the radiator is disposed in a portion of the case in which the battery of the portable device is mounted and is separated from the battery by a predetermined gap.

7. The antenna of claim 6, wherein the resonant frequency compensation unit is housed in a battery cover detachable from the portable device.

8. The antenna of claim 7, wherein the resonant frequency compensation unit is a dielectric substance having the predetermined dielectric constant set based on a capacity or a size of the battery mounted at a periphery of the radiator.

9. The antenna of claim 7, wherein the resonant frequency compensation unit comprises the battery cover having the predetermined dielectric constant.

10. The antenna of claim 1, wherein the resonant frequency compensation unit comprises a battery cover having the predetermined dielectric constant which is set in accordance with at least one of the particular color of the case, and a battery size.

11. The antenna of claim 1, wherein the resonant frequency compensation unit is made of one of acrylonitrile, butadiene, and styrene (ABS), polyamide (PA), polyacetal (POA), polycarbonate (PC), modified polyoxide (M-PRO), polybutylene terephthalate (PBT), polyimide (PI), polyphenylenesulfide (PPS), polyamide imide (PAT), polyetherimide (PEI), polyether ketone (PEK), liquid crystal polyester (LCP), syndiotactic polypropylene (SPS) or a synthetic substance thereof.

12. The antenna of claim 1, wherein the preset resonant frequency is set to a specific resonant frequency of the radiator related to at least one of any one color and any one material in which the portable device is painted and a predetermined capacity of the battery mounted at a periphery thereof.

13. The antenna of claim 6, wherein the radiator is housed at a lower end portion of the case adjacent to the battery.

14. The antenna of claim 1, wherein the radiator is formed with silver (Ag) paste, copper (Cu) paste, or a synthetic substance thereof.

15. A battery cover detachable from a case of a portable device in which a battery and an antenna are housed and separated by a predetermined gap, the battery cover comprising:

a resonant frequency compensation unit attached to or forming at least a part of the battery cover facing the antenna, and having a predetermined dielectric constant set to adjust a resonant frequency of the antenna changed by an environmental condition to a preset resonant frequency, wherein the environmental condition is at least one of an effective dielectric constant of a case with a particular color or material painted thereon, or the presence of a type of battery mounted within the portable device.

16. The battery cover of claim 15, wherein the environmental condition is the effective dielectric constant of the case.

17. The battery cover of claim 15, wherein the resonant frequency compensation unit is provided with a dielectric substance having the predetermined dielectric constant, which is set based on the type of the battery, the type being defined by a capacity and size of the battery.

18. The battery cover of claim 17, wherein the dielectric substance is attached to a portion of the battery cover, and the resonant frequency is adjusted according to adjustment of at least one parameter of an area, length, and width of the resonance frequency compensation unit.

19. The battery cover of claim 17, wherein the dielectric substance is provided in the battery cover having a predetermined dielectric constant.

20. A portable device having an antenna, comprising:

a case in which a battery is mounted;

an antenna radiator patterned at a surface of a lower end portion of the case;

a battery cover detached from the case and for covering the battery; and a dielectric tuner housed in the battery cover facing the antenna radiator, and having a predetermined dielectric constant set to adjust a resonant frequency of the antenna changed by an environment change condition to a preset resonant frequency, wherein the environmental condition is at least one of an effective dielectric constant of a case with a particular color or material painted thereon, or the presence of a type of battery mounted within the portable device.

21. The portable device of claim 20, wherein the antenna radiator is electrically connected to a main printed circuit board (PCB) mounted within the case and transfers a received signal to the main PCB.

* * * * *

UNITED STATES PATENT AND TRADEMARK OFFICE

CERTIFICATE OF CORRECTION

PATENT NO. : 9,300,049 B2
APPLICATION NO. : 14/012197
DATED : March 29, 2016
INVENTOR(S) : Myungjae Jo It is certified that error appears in the above-identified patent and that said Letters Patent is hereby corrected as shown below:

In the Claims

Column 10, Claim 11, Line 18 should read as follows:
--...polyamide imide (PAI), polyetherimide...--

Column 11, Claim 20, Line 2 should read as follows:
--...environment condition to a...--

Signed and Sealed this
Twenty-fourth Day of May, 2016

Michelle K. Lee

Michelle K. Lee
*Director of the United States Patent and Trademark Office*